US009003948B2

(12) United States Patent
Brown

(10) Patent No.: US 9,003,948 B2
(45) Date of Patent: Apr. 14, 2015

(54) FIRE CONTROL SWITCH FOR FIREARM

(75) Inventor: Michael Jay Brown, Baltimore, MD (US)

(73) Assignee: Ambimjb LLC, Baltimore, MD (US)

( * ) Notice: Subject to any disclaimer, the term of this patent is extended or adjusted under 35 U.S.C. 154(b) by 173 days.

(21) Appl. No.: 13/530,730

(22) Filed: Jun. 22, 2012

(65) Prior Publication Data

US 2012/0325044 A1 Dec. 27, 2012

Related U.S. Application Data

(60) Provisional application No. 61/571,250, filed on Jun. 23, 2011.

(51) Int. Cl.
*F41A 19/33* (2006.01)
*F41A 35/06* (2006.01)

(52) U.S. Cl.
CPC ..... *F41A 35/06* (2013.01); *F41A 19/33* (2013.01)

(58) Field of Classification Search
USPC ..... 89/142, 148, 150, 154; 403/325, 327, 403/328, 330, 331; 42/70.01–70.11
See application file for complete search history.

(56) References Cited

U.S. PATENT DOCUMENTS

| | | | | | |
|---|---|---|---|---|---|
| 593,190 | A * | 11/1897 | Bernhardt | 285/317 |
| 1,303,090 | A * | 5/1919 | McCray | 30/308.3 |
| 2,117,947 | A * | 5/1938 | De Rome et al. | 292/352 |
| 2,210,797 | A * | 8/1940 | Crim | 292/354 |
| 2,494,159 | A * | 1/1950 | Bernstein | 220/759 |
| 2,639,158 | A * | 5/1953 | Procos | 279/77 |
| 2,682,414 | A * | 6/1954 | Richardson | 279/77 |
| 3,526,040 | A * | 9/1970 | Young | 33/809 |
| 4,220,360 | A * | 9/1980 | Jacek et al. | 285/317 |
| 4,414,769 | A | 11/1983 | Mueschke | |
| 4,502,807 | A * | 3/1985 | Salice | 403/11 |
| 4,615,236 | A * | 10/1986 | Boots | 74/545 |
| 4,726,136 | A | 2/1988 | Dornaus et al. | |
| 5,212,327 | A | 5/1993 | Schuemann | |
| 5,373,608 | A * | 12/1994 | Welch | 16/425 |
| 7,421,937 | B1 * | 9/2008 | Gangl | 89/142 |
| 7,654,187 | B2 | 2/2010 | Hochstrate et al. | |
| 8,276,502 | B1 * | 10/2012 | Wright | 89/148 |
| 8,650,790 | B2 * | 2/2014 | Dionne et al. | 42/70.11 |
| 8,661,722 | B2 * | 3/2014 | Dionne et al. | 42/70.11 |
| 2007/0180984 | A1 | 8/2007 | Huther | |
| 2008/0302235 | A1 | 12/2008 | Lauck | |
| 2013/0111794 | A1 * | 5/2013 | Dionne et al. | 42/70.01 |

(Continued)

OTHER PUBLICATIONS

Troy Industries, Inc., Brochure, Receiver Versatility Enhancements, Ambidextrous Safety Selector, Item Nos. SSAF-AMB-FOBT-00 and SSAF-AMB-SOBT-00, p. 62.

(Continued)

*Primary Examiner* — Jonathan C Weber
(74) *Attorney, Agent, or Firm* — Howard & Howard Attorneys PLLC

(57) ABSTRACT

A fire control switch for a firearm includes a lever assembly mounted to a first end or to a second end of a shaft. The lever assembly includes a spring-loaded rotatable pawl moveable between a first position and a second position, wherein the lever assembly is mounted to the shaft when the pawl is in the first position and can be released from the shaft by moving the pawl from the first position to the second position. In other embodiments, a second lever assembly or cap may be mounted to the other end of the shaft.

20 Claims, 3 Drawing Sheets

(56) References Cited

U.S. PATENT DOCUMENTS

| | | | | |
|---|---|---|---|---|
| 2013/0111795 | A1* | 5/2013 | Dionne et al. | 42/70.11 |
| 2013/0111796 | A1* | 5/2013 | Dionne et al. | 42/70.11 |

OTHER PUBLICATIONS

Troy Industries, Inc., Ambidextrous Safety Selector installation guide, 5 pages.

Troy Industries, Inc., Ambidextrous Safety Selector—Fully Automatic, retrieved from http://troyind.com/%20/weapon-upgrades/enhancements/troy-ambidextrous-safety-selector-fully-automatic website on May 24, 2011, 1 page.

Small Arms Review, Battlearms Development Ambidextrous Safety Selector, vol. 14, No. 9, p. 11 dated Jun. 2011, 1 page.

Battlearms Development, Inc.—Ambidextrous Safety Selector, retrieved from http://battlearmsdevelopment.com/badass.php website on Oct. 8, 2012, 1 page.

* cited by examiner

FIRE CONTROL SWITCH FOR FIREARM

CROSS REFERENCE TO RELATED APPLICATIONS

The present application claims priority from U.S. Provisional Application Ser. No. 61/571,250, filed Jun. 23, 2011, which is herein incorporated by reference.

FIELD OF THE INVENTION

The invention generally relates to a fire control switch and, more specifically, to a fire control switch for ambidextrous use.

BACKGROUND OF THE INVENTION

An automatic or semi-automatic firearm can provide a fire control switch enabling a user to switch between a plurality of fire modes, such as, safe, semi-automatic, burst and/or automatic. The firearm has a left side and a right side, and defines a bore that transverses through the left side and right side. A shaft traverses the bore of the firearm. The shaft has a first end and a second end that are spaced from each other in opposing relation. A lever couples to either the first end or the second end of the shaft, and extends along the left side or the right side of the firearm.

Typically, a thumb of the user actuates the lever of the fire control switch. Actuation of the lever results in rotation of the shaft. The shaft can possess a plurality of camming surfaces set between the first end and the second end to facilitate firing and securing of the firearm. As such, based on the orientation of the camming surfaces, the firearm operates according to the fire mode selected. Conventionally, the lever can be located on a left side of the firearm and actuated by the thumb located on the user's right hand. Alternatively, the lever can be located on the right side of the firearm and actuated by the thumb located on the user's left hand.

An ambidextrous fire control switch is required for users of the firearm that would like the option to switch the fire mode using their left hand, right hand and/or both. As such, there remains a need to provide an improved fire control switch whereby a lever can be coupled to either end or both ends of the shaft by a tool-less and reliable mechanism.

SUMMARY OF THE INVENTION

A fire control switch for a firearm comprising a shaft having a first end and a second end. A first lever is mountable to one of the first end and the second end of the shaft with the first lever having a body portion defining an internal space extending to an inner wall. A first pawl is rotatably coupled to the body portion of the first lever and disposed within the internal space with the first pawl having a top end and a bottom end and being rotatable between a first position for retaining the first lever on the shaft and a second position for permitting the first lever to be released from the shaft. A first spring coupled between the top end of the first pawl and the inner wall within the internal space for biasing the first pawl toward the first position.

In certain other embodiments, a lever assembly for coupling to a shaft to form a fire control switch is disclosed, in which the lever assembly comprises a head portion having a lever lip. A body portion extends from the head portion and defines an internal space extending to an inner wall. A pawl is rotatably coupled to the body portion and is disposed within the internal space. The pawl has a top end and a bottom end with the pawl being rotatable between a first position and a second position within the internal space. A spring is coupled between the top end of the pawl and the inner wall and located within the internal space for biasing the pawl toward the first position.

BRIEF DESCRIPTION OF THE DRAWINGS

Advantages of the present invention will be readily appreciated, as the same becomes better understood by reference to the following detailed description when considered in connection with the accompanying drawings.

DETAILED DESCRIPTION OF THE EXEMPLARY EMBODIMENTS

Figure 1:
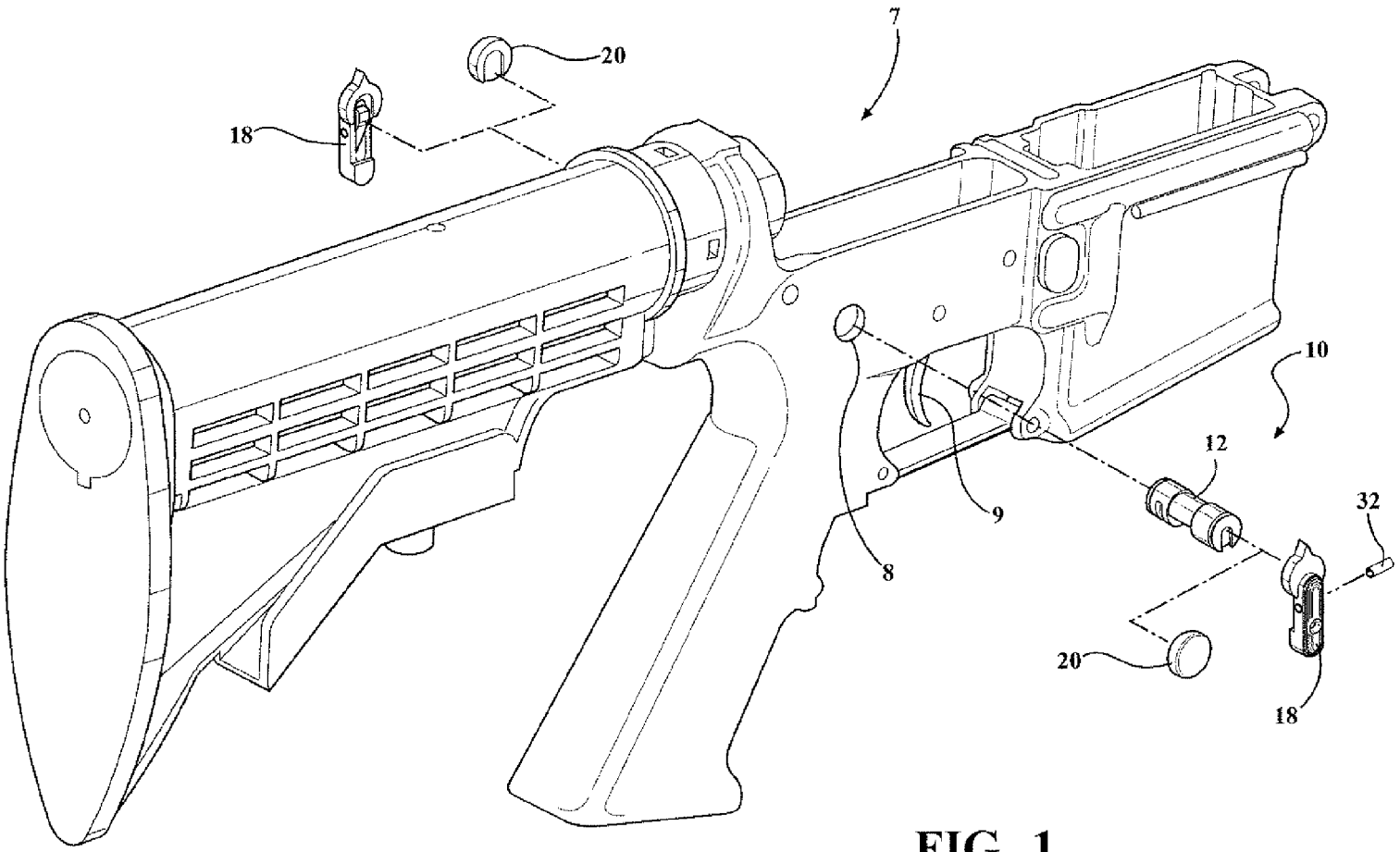
FIG. 1 is an exploded view of a portion of a firearm and a fire control switch in accordance with one exemplary embodiment of the present invention.
Figure 3:
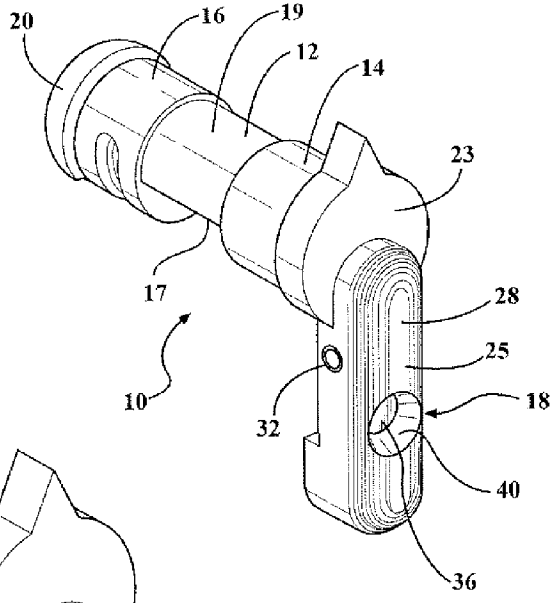
FIG. 3 is a perspective view of the fire control switch in accordance with another exemplary embodiment of the present invention with a cap disposed on a first end of the shaft and a lever disposed on a second end of the shaft.

Referring to the Figures, wherein like numerals indicates like or corresponding parts throughout the several views, a fire control switch for an automatic or semi-automatic firearm (a portion of the firearm is shown generally as 7 in FIG. 1) is shown generally as 10.

The fire control switch 10 includes a shaft 12 that is coupled through a bore 8 in a portion of the firearm 7 near a trigger 9. The shaft 12 has a first end 14 and a second end 16 spaced from each other in opposing relation. In addition, a lever assembly 18 is mountable to the first end 14 and/or to the second end 16 of the shaft 12. A thumb of the user actuates the lever assembly 18 (i.e. rotates the lever assembly 18) of the fire control switch 10, and the rotation of the lever assembly 18 in turn causes the shaft 12 to rotate within the bore 8 of the firearm 7 in response.

Figure 2:
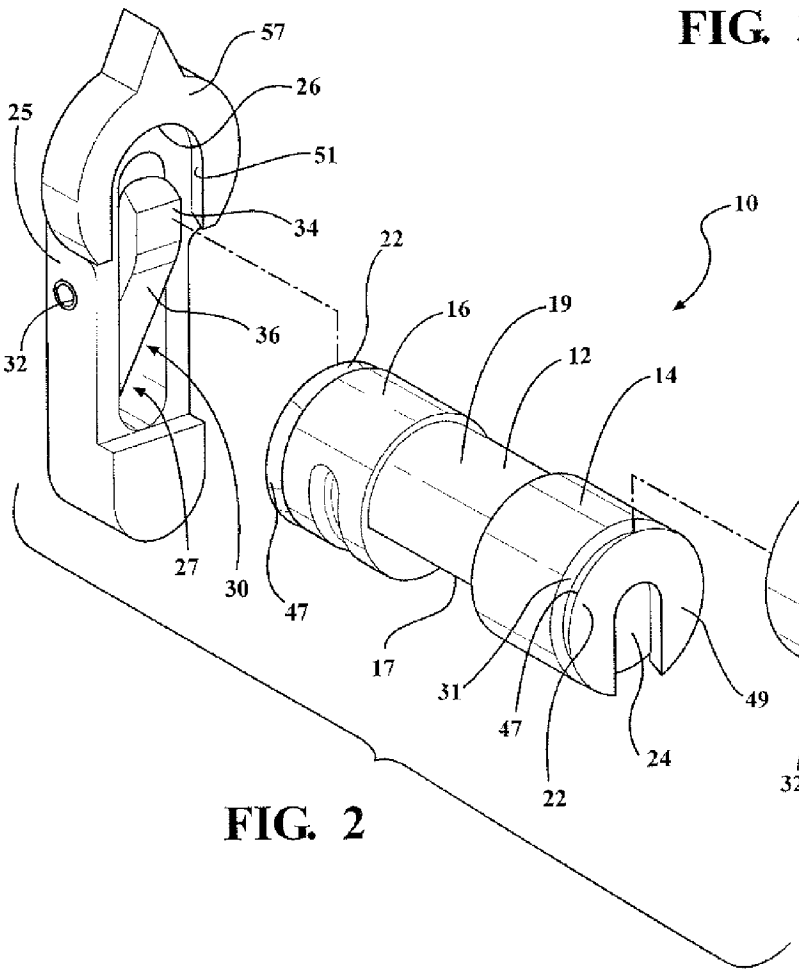
FIG. 2 is an exploded view of the fire control switch in accordance with one exemplary embodiment of the present invention with levers disposed on both ends of a shaft.

In certain embodiments, the lever assembly 18 may be mounted to the first end 14 of the shaft 12 for one-hand operation. Alternatively, the lever assembly 18 maybe mounted to the second end 16 of the shaft 12 for opposite-hand operation. In either of these embodiments, a cap 20 may be mounted to the other end 14, 16 of the shaft 12. In yet another embodiment, a lever assembly 18 can include a first lever mounted to the first end 14 and a second lever assembly 18 is reversibly mounted to the second end 16 of the shaft 12 (such as shown in FIG. 2 prior to mounting) for ambidextrous operation. For an added degree of safety, the lever assembly 18 and the cap 20 can be removed from the shaft 12 to prevent rotation of the shaft 12 from a safety position within the bore 8. The method for mounting and releasing the lever assembly 18 from the shaft 12 is described in further detail below.

The shaft 12 includes a plurality of camming surfaces set between the first end 14 and the second end 16 to facilitate firing and securing of the firearm 7. As one of ordinary skill in the art of weaponry readily recognizes, each relative orientation of the plurality of camming surfaces within the bore 8 is associated with other components of the firearm 7, including the trigger 9, which control the firing of the firearm 7. In other words, each camming surfaces is associated with a corresponding firing mode of the firearm 7, wherein possible firing modes for the firearm include safe, semi-automatic, burst and/or automatic. Thus, the rotation of the lever assembly 18, and hence the rotation of the shaft 12, alters the relative orientation of the plurality of camming surfaces within the bore 8 to determine the firing mode of the weapon.

In certain embodiments, such as those shown in FIGS. 1-5, the plurality of camming surfaces comprises two camming surfaces 17 and 19. In such embodiments, the firearm 7 is switchable between a safe mode and a firing mode by rotating the lever assembly 18 from a safe position to a firing position, with one the camming surface 17 or 19 associated with the safe mode and the other camming surface 17 or 19 associated with the firing mode. As one of ordinary skill appreciates, the number of camming surfaces may be more than two to accommodate additional firing modes such as semi-automatic, burst and/or automatic as described previously wherein, as above, the relative positioning of the additional camming surfaces is associated with the additional firing modes. In these embodiments, the user rotates the lever assembly 18 through a corresponding number of relative positions associated with each camming surface, with each relative position of the lever assembly associating a particular camming surface within the bore 8 to determine the firing mode selected. Thus, the present invention is not limited to the embodiments including two camming surfaces 17 and 19 as disclosed in the Figures provided herein.

Figure 4:
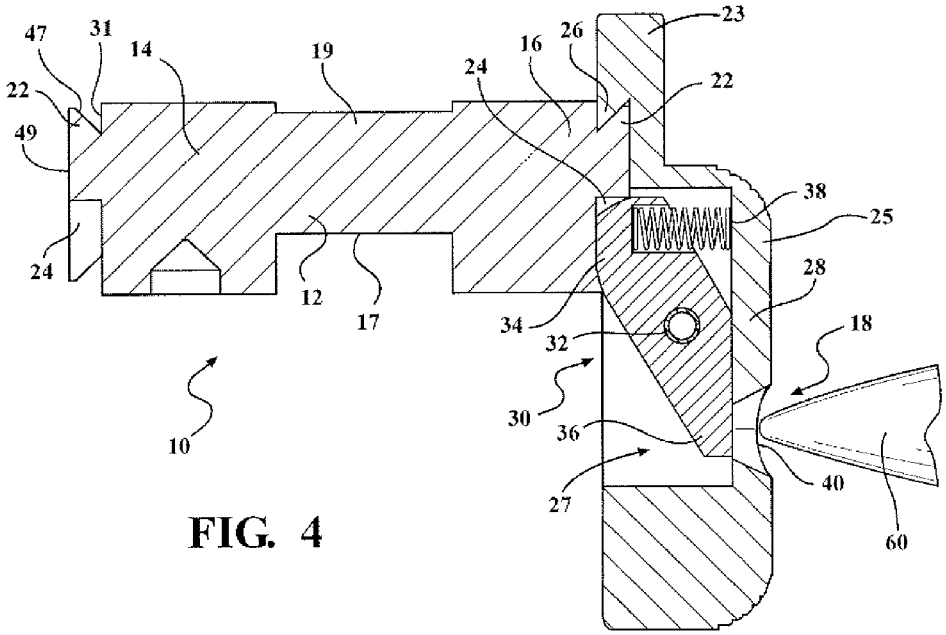
FIG. 4 is a cross-sectional view of the fire selector switch, wherein the pawl is in the first position.
Figure 5:
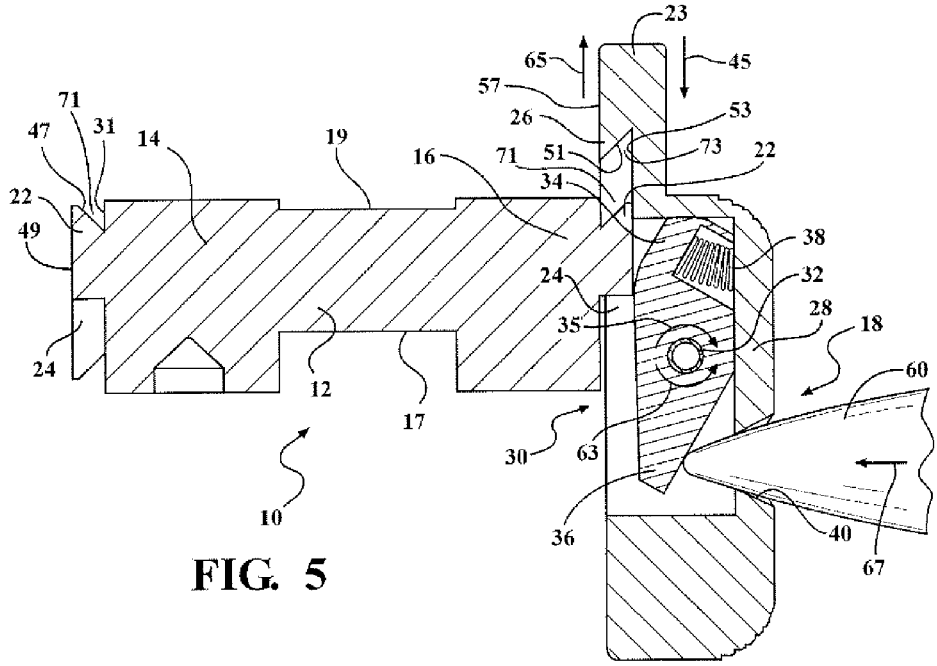
FIG. 5 is a cross-sectional view of the fire selector switch wherein the pawl is in the second position.

As best shown in FIGS. 2, 4 and 5, the first end 14 and the second end 16 of the shaft 12 each have a shaft lip 22 that extends from an outer portion 31. The shaft lip 22 also includes an outer surface 49 and an angled inner surface 47 that extends between the outer surface 49 and the outer portion 31. The angled inner surface 47 and the outer portion 31 of the first end 14 and the second end 16 define a respective shaft lip groove 71 there between. In certain embodiments, the shaft lip groove 71 has a dovetailed configuration, such as shown best in FIGS. 4 and 5.

In certain embodiments, the outer surface 49 is parallel to the outer portion 31. A recess 24 (as best shown in FIG. 2) is defined within the outer portion 31 of the first end 14 (or the second end 16) of the shaft lip 22. In other words, a portion of the shaft lip 22 at least partially surrounds the recess 24. In certain embodiments, the recess 24 defines a portion of the shaft lip groove 71. The recess 24, as shown in FIG. 2, has an inverted U-shaped configuration that accommodates a portion of a pawl 30, as will be described in further detail below The lever assembly 18 includes a lever having a head portion 23 and a body portion 25 extending from the head portion 23. As mentioned above, there may be a first lever and a second lever for ambidextrous use of the five control switch. For descriptive purposes, a single lever assembly will be subsequently described. It should be appreciated that this lever assembly may be utilized on either end of the shaft.

The head portion 23 includes a lever lip 26 complementary to the shaft lip 22. The lever lip 26 includes an angled interior surface 51, an outer surface 57 including a lower portion 59, and an inner surface 53. In certain embodiments, the inner surface 53 is parallel to the outer surface 57. In certain embodiments, the angled interior surface 51 is parallel to the angled inner surface 47 when the lever assembly 18 is mounted to the shaft 12. The angled interior surface 51 and the inner surface 53 define a lever lip groove 73 there between. In certain embodiments, the lever lip groove 73 has a dovetailed configuration, such as shown best in FIGS. 4 and 5.

The body portion 25 defines an internal space 27 extending to an internal wall 28. The external surface of the body portion 25 opposite the internal wall 28 may be ridged, such as shown in FIGS. 1-5, or otherwise textured to allow the lever 18 to be easily gripped by a user as it is being installed, released or otherwise moved. The lever assembly 18 includes a pawl 30, which is disposed within the internal space 27 of the lever assembly 18. The pawl 30 has a top end 34 and a bottom end 36 and is complimentary in size and shape to be accommodated within the recess 24 of the shaft lip 22 when the lever assembly 18 is mounted to the shaft 12. As shown, the complementary top surface of the top end 34 is curved to match the shape of the curved upper surface of the inverted U-shaped recess 24, as shown best in FIG. 2.

The lever assembly 18 further includes a pin 32, which rotatably fixes the pawl 30 within the internal space 27. The pin 32 may be hollowed, as shown in FIGS. 1, 4 and 5, or solid in design. The pawl 30 rotates between a first position (shown in FIG. 4) and a second position (shown in FIG. 5) within the internal space 27. The lever assembly 18 also includes a spring 38 located between the top end 34 of the pawl 30 and the internal wall 28 within the internal space 27. The spring 38 is configured to bias the top end 34 of the pawl 30 towards the first position. The lever assembly 18 defines a hole 40 adjacent to the bottom end 36 of the pawl 30. As will be discussed further below, the hole 40 provides an access point to the bottom end 36 of the pawl 30 to allow the release of the lever assembly 18 from the shaft 12. In certain embodiments, such as shown in FIGS. 2-5, the hole 40 is chamfered.

As shown best in FIG. 4, when the lever assembly 18 is mounted to the shaft 12, the lever lip 26 engages the shaft lip 22 and the top end 34 of the pawl 30 engages the recess 24 of the shaft lip 22. In addition, the angled inner surface 47 of the shaft lip 22 is engaged (or contacted) to the angled interior surface 51 of the lever lip 26, while the outer surface 49 of the shaft lip 22 is engaged with the inner surface 53 of the lever lip 26. In addition, the lower portion 59 of the outer surface 57 of the lever lip 26 is engaged to the inner surface 31 of the first end 14 (or the second end 16).

Stated differently, when the lever assembly 18 is mounted to the shaft 12, the lever lip 26 is contained within the shaft lip groove 71, while the shaft lip 22 is contained within the lever lip groove 73. As such, the lever lip groove 73 abuts the shaft lip groove 71 when the lever is mounted to the shaft. In addition, the top end 34 of the pawl 30 engages the recess 24 of the shaft lip 22.

To mount the lever assembly 18 to the first end 14 (or to the second end 16) of the shaft 12, the lever lip 26 is first placed in close proximity to the shaft lip 22 such that the inner surface 53 of the lever lip 26 is brought into contact with a corresponding outer surface 49 of shaft lip 22, wherein the angled interior surface 51 of the lever lip 26 is displaced from the angled inner surface 47 of the shaft lip 22 (as shown in FIG. 4, the angled interior surface 51 is above and parallel to the angled inner surface 47). As the inner surface 53 is contacting the outer surface 49, the top end 34 of the pawl 30 is also contacting the outer surface 49, therein causing the pawl 30 to rotate from the first position to the second position in response (shown as clockwise rotation by arrow 35 in FIG. 5), thereby compressing the spring 38.

Next, the lever assembly 18 is moved in a second direction (downward as shown by arrow 45 in FIG. 5) to engage (or contact) the angled interior surface 51 with the angled inner surface 47 (as shown best in FIG. 4). In this engaged position, the top end 34 of the pawl 30 is no longer contacting the outer surface 49 of the shaft lip 22, and thus the biasing force of the spring 38 causes the pawl 30 to rotate from the second position to the first position (shown as counterclockwise rotation by arrow 63 in FIG. 5) such that the top end 34 of the pawl 30 is contained within the recess 24, therein mounting the lever assembly 18 to the shaft 12.

To release the lever assembly 18 from the shaft 12, as best shown in FIG. 5, a cylindrical member (such as a firing pin or a bullet 60 as shown in FIGS. 4 and 5) is inserted through the hole 40 (as shown by arrow 67) in the body portion 25 and engages the pawl 30 to rotate the pawl 30 from the first position to the second position (clockwise as shown by arrow 35). In other words, the force (as shown by arrow 67 in FIG. 5) applied by the cylindrical member 60 to the bottom end 36 of the pawl 30 overcomes a bias force of the spring 38 and rotates the top end 34 of the pawl 30 from the second position to the first position and out of engagement with the recess 24 of the shaft lip 22, as shown in FIG. 5. Once the pawl 30 is disengaged from the recess 24, the lever assembly 18 is moved in a first direction (upward as shown by arrow 65 in FIG. 5) until the lever lip 26 is free of the shaft lip 22, therein releasing the lever assembly 18 from the shaft 12.

The shaft 12 and the head portion 23 and body portion 25 of the lever assembly 18 may be formed by any suitable method, such as for example, casting, machining, etc. of any suitable material(s), including, for example, hard metals or metal alloys such as steel.

The invention has been described in an illustrative manner, and it is to be understood that the terminology that has been used is intended to be in the nature of words of description rather than of limitation. It is now apparent to those skilled in the art that many modifications and variations of the present invention are possible in light of the above teachings. It is, therefore, to be understood that the invention can be practiced otherwise than as specifically described.

What is claimed is:

1. A fire control switch for a firearm comprising:

a shaft having a first end and a second end;

a first lever mountable to one of said first end and said second end of said shaft with said first lever having a body portion defining an internal space extending to an inner wall, and said body portion defining a hole disposed therethrough in communication with said internal space;

a first pawl rotatably coupled to said body portion of said first lever and disposed within said internal space with said first pawl having a top end and a bottom end and being rotatable between a first position for retaining said first lever on said shaft and a second position for permitting said first lever to be released from said shaft, and said bottom end of said first pawl at least partially covering said hole without exiting said hole to provide access to said bottom end of said first pawl within said internal space; and a first spring coupled between said top end of said first pawl and said inner wall within said internal space for biasing said first pawl toward said first position.

2. The fire control switch of claim 1, wherein said first end and said second end of said shaft each have a shaft lip defining a recess.

3. The fire control switch of claim 2, wherein said shaft lip has an outer surface and an angled inner surface extending between said outer surface and an outer portion of one of said first end and said second end, said angled inner surface and said outer portion of one of said first end and said second end defining a shaft lip groove.

4. The fire control switch of claim 3, wherein said recess defines a portion of said shaft lip groove.

5. The fire control switch of claim 4, wherein said shaft lip groove has a dove-tail configuration.

6. The fire control switch of claim 3, wherein said outer surface of said shaft lip partially surrounds said recess.

7. The fire control switch of claim 3, wherein said first lever includes a head portion mounted to said body portion with said head portion having a lever lip defining an angled interior surface located between an outer surface and an inner surface with said angled interior surface and said inner surface of said lever lip defining a lever lip groove.

8. The fire control switch of claim 7, wherein said lever lip groove of said first lever abuts said shaft lip groove of said shaft and said pawl is in said first position contained within said recess when said first lever is mounted to said shaft.

9. The fire control switch of claim 2, wherein said recess has an inverted U-shaped configuration.

10. The fire control switch of claim 1, wherein said first lever includes a head portion mounted to said body portion with said head portion having a lever lip for mounting said first lever to said one of said first end and said second end of said shaft.

11. The fire control switch of claim 10, wherein said lever lip has an angled interior surface located between an outer surface and an inner surface with said angled interior surface and said inner surface of said lever lip defining a lever lip groove.

12. The fire control switch of claim 1 further comprising a first pin for rotatably mounting said first pawl to said body portion of said first lever.

13. The fire control switch of claim 1 further comprising a second lever mountable to an other one of said first end and said second end of said shaft with said second lever having a body portion defining an internal space extending to an inner wall;

a second pawl rotatably coupled to said body portion of said second lever and disposed within said internal space with said second pawl having a top end and a bottom end and being rotatable between a first position for retaining said second lever on said shaft and a second position for permitting said second lever to be released from said shaft; and a second spring coupled between said top end of said second pawl and said inner wall within said internal space for biasing said second pawl toward said first position.

14. The fire control switch of claim 1 further comprising a cap mountable to an other of said first end and said second end of said shaft.

15. The fire control switch of claim 1, wherein said shaft further comprises a plurality of camming surfaces located between said first end and said second end.

16. A fire control switch for a firearm comprising:

a shaft having a first end and a second end with each end having a shaft lip defining a shaft lip groove with said shaft lip groove having a top shaft groove portion and a pair of side shaft groove portions, each end of said shaft also defining a recess having an inverted U-shaped configuration relative to said top shaft groove portion;

a lever assembly mountable to one of said first end and said second end of said shaft with said lever assembly comprising:

a head portion having a lever lip defining a lever lip groove having a top lever groove portion and a pair of side lever groove portions with said top lever groove portion of said lever assembly directly engaging said top shaft groove portion of said shaft and said side shaft groove portions of said lever assembly directly engaging said side lever groove portions, respectively, when said lever assembly is mounted to said shaft;

a body portion extending from said head portion and defining an internal space extending to an inner wall;

a pawl rotatably coupled to said body portion and disposed within said internal space, said pawl having a top end and a bottom end with said pawl being rotatable between a first position and a second position within said internal space with said top end of said pawl contained within said recess when in said first position to wedge a section of said shaft lip between said pawl and said head portion when said lever assembly is mounted to said shaft, and said pawl permitting said lever assembly to be released from said shaft when in said second position; and a spring coupled between said top end of said pawl and said inner wall and located within said internal space for biasing said pawl toward said first position.

17. The fire control switch of claim 16, wherein said body portion has a hole for permitting engagement with said bottom end of pawl within said internal space to move said pawl into said second position and release said lever assembly from said shaft.

18. The fire control switch of claim 16, wherein said lever lip has an angled interior surface located between an outer surface and an inner surface, said angled interior surface and said inner surface defining said lever lip groove.

19. The fire control switch of claim 16 further comprising a pin rotatably mounting said pawl to said body portion.

20. The fire control switch of claim 16, wherein said shaft lip has an outer surface and an angled inner surface extending between said outer surface and an outer portion of one of said first end and said second end, said angled inner surface and said outer portion of one of said first end and said second end defining said shaft lip groove.

* * * * *